United States Patent [19]

Meyer

[11] 4,157,819

[45] Jun. 12, 1979

[54] ADJUSTABLE WORK PIECE CLAMPING SYSTEM

[76] Inventor: Richard W. Meyer, 6169 Coloma Dr., Goleta, Calif. 93017

[21] Appl. No.: 762,868

[22] Filed: Jan. 27, 1977

[51] Int. Cl.[2] ..... B25B 1/08

[52] U.S. Cl. ..... 269/231; 269/303; 269/321 A

[58] Field of Search ..... 269/321 A, 231, 236, 269/279, 144, 280, 47, 307, 138, 303-304; 144/307

[56] References Cited

U.S. PATENT DOCUMENTS

| | | | |
|---|---|---|---|
| 24,009 | 5/1859 | Crowell et al. | 269/236 |
| 406,828 | 7/1889 | Fietsch | 144/307 |
| 3,608,886 | 9/1971 | Greene | 269/307 |
| 3,827,685 | 8/1974 | Wennes | 269/321 |

FOREIGN PATENT DOCUMENTS

| | | | |
|---|---|---|---|
| 929554 | 12/1947 | France | 269/321 |
| 1231204 | 5/1971 | United Kingdom | 269/47 |

*Primary Examiner*—Robert C. Watson
*Attorney, Agent, or Firm*—Spensley, Horn & Lubitz

[57] ABSTRACT

The Adjustable Work Piece Clamping System permits a work piece to be held firmly on a work surface. It employs a clamping member having a spiral outer surface, this clamping member being pivotally attached to the work surface, preferably by a pin linked to the clamping member and received in one of a grid of openings provided in the work surface. It may employ other members adjustably attached to the work surface, preferably by pins, these members including a fence, an adjustable clamping member incorporating a pivotally attached shoe, and various other components set forth in the following specification. By employing the clamping member and these other components, a work piece of most any material may be firmly and quickly fixed on the work surface in virtually any position for cutting, face finishing or assembly, then easily removed upon completion of the operation.

4 Claims, 22 Drawing Figures

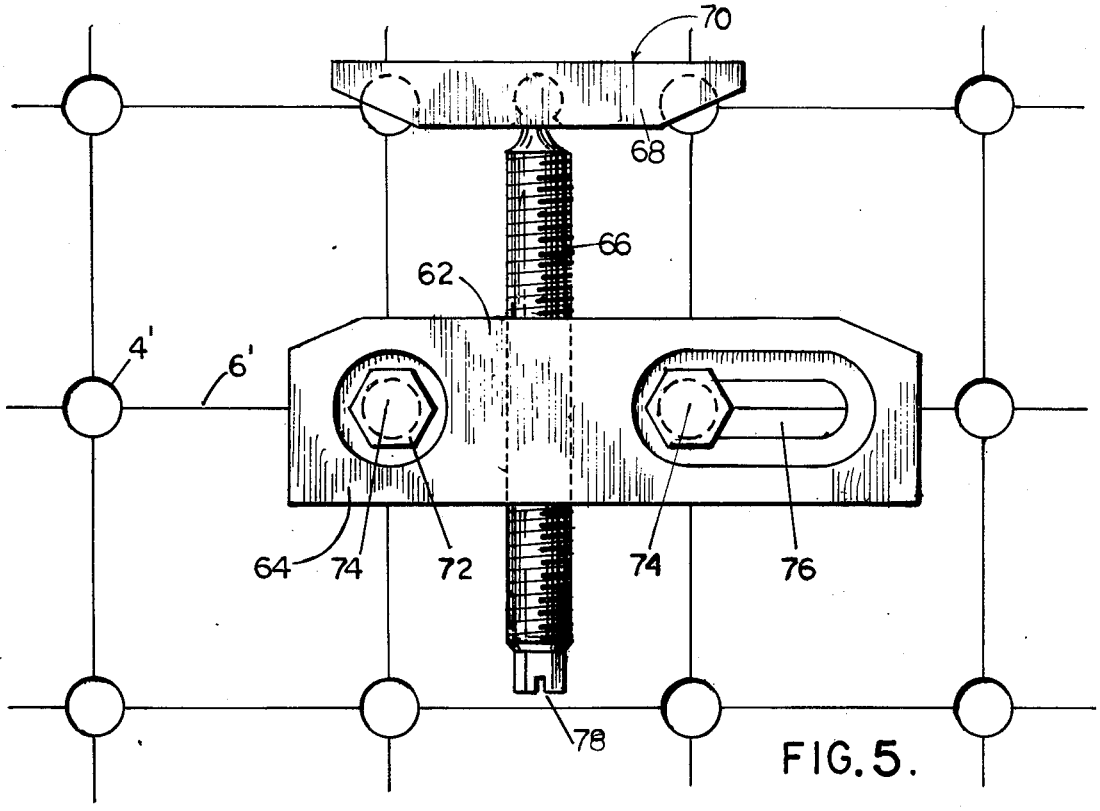
FIG. 5.
FIG. 6
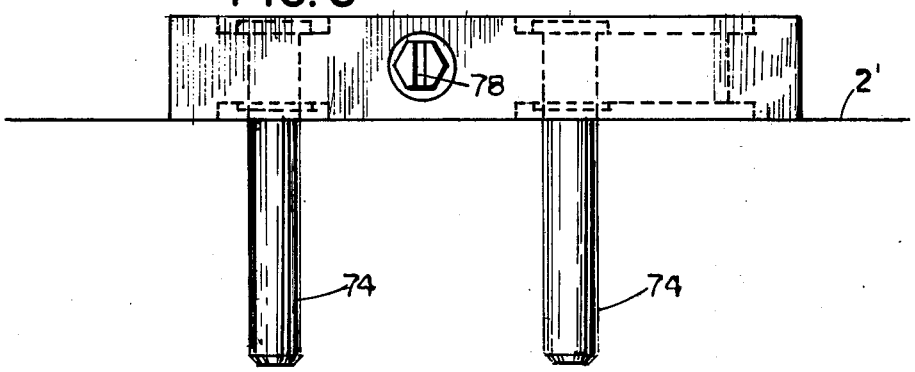
FIG. 7.
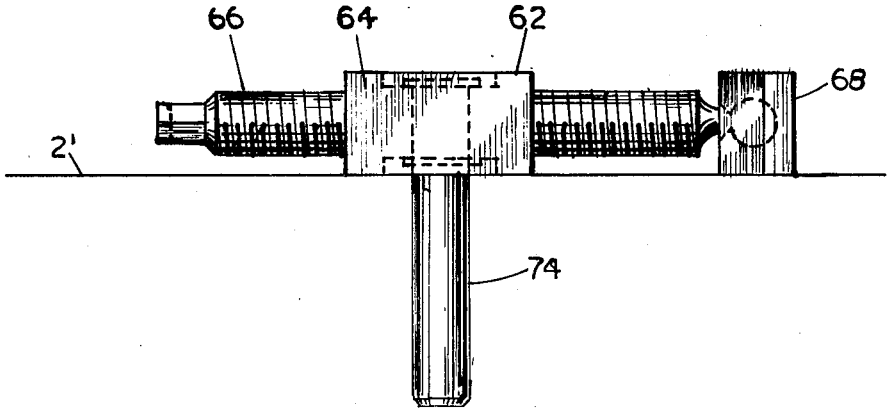

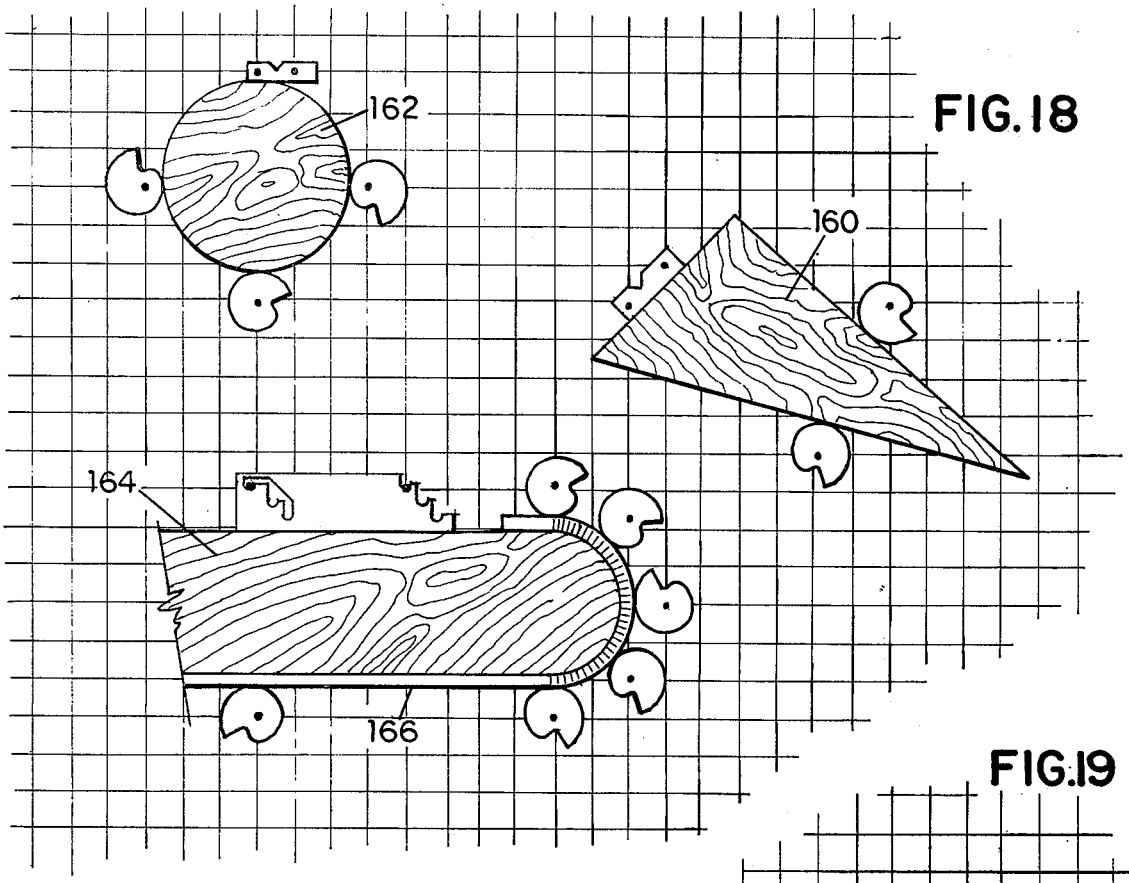
FIG. 18
FIG. 19
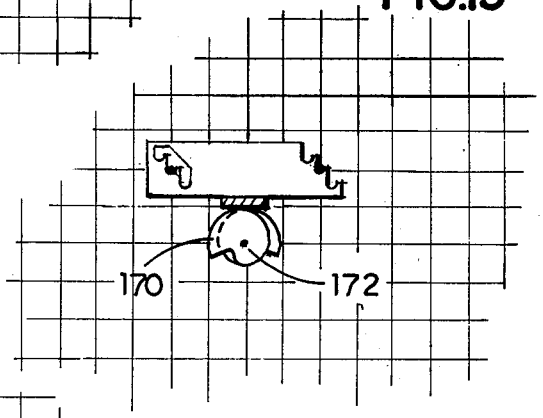
FIG. 20
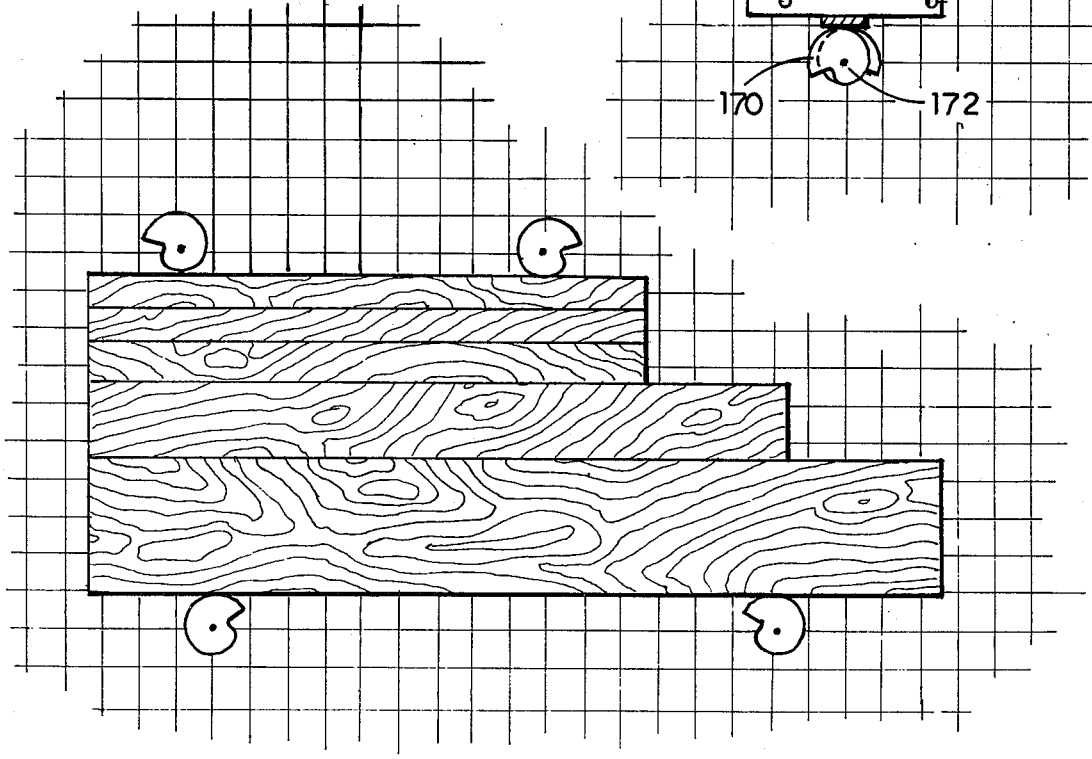

ADJUSTABLE WORK PIECE CLAMPING SYSTEM

BACKGROUND OF THE INVENTION

For ages the need has existed for a system to firmly hold a work piece on a work surface in a given position. A variety of structures have been devised to meet this need, including the basic bench vise and many modifications of that simple structure. Among the more recent modifications is a table that incorporates a screw vise face at one end and an adjustable fence attached to the surface of the table, thereby permitting a work piece to be clamped between the vise face and the fence. Another modification of the basic bench vise provides a work table surface in two halves which may be moved together by a screw vise structure, the halves of the work table surface including movable stops permitting a work piece to be clamped between these stops as the halves of the work table surface are brought together. While certainly such structures are suitable for some operations, they offer very limited flexibility which in turn limits their usefulness in many work-piece operations. They also, for the most part, include structures which may project above the surface of the work piece, this projection limiting the ability of the user to perform important operations such as finishing the surface of the work piece. In addition, they do not permit the work piece conveniently to be clamped in a position spaced above the work surface as is required, for example, in certain saber sawing and routing operations. Also, they really aren't adapted to holding irregularly shaped objects.

The present invention presents an adjustable work-piece clamping system that offers the capability of holding virtually any size or shape work piece firmly in a fixed position. Thus, it greatly enhances the user's ability to produce quality craftsmanship. It is quick and simple to use. The clamping components are quite short, do not project above the surface of most work pieces, permitting unobstructed surface operations to be perofmred. It accommodates both rectangular and irregularly shaped articles. It may be employed for assembly operations as well as cutting and finishing operations. It locks the work piece against movement in any direction. When desired it will hold the work piece above the work surface. It is simple and economical in construction, and flexible and adaptable in use. In short, it is believed to offer to both the professional craftsman and home handyman an ideal work-piece clamping system.

BRIEF SUMMARY OF THE INVENTION

The disclosed adjustable work-piece clamping system provides a work surface, typically a table, to which the work piece is held by an arrangement of clamping members. The basic clamping member includes a spiral outer surface and is pivotally attached to the work surface, for example by a pin received in any of a grid of openings in the work surface. By arranging these clamping members about the periphery of an article to be held on the work surface, then rotating them to cause their spiral outer surfaces to firmly bear on the article, it may be clamped to the work surface. The system may employ a fence also preferably attached to the work surface by pins. It may employ a screw-clamping member having a plate attached by pins or the like to the work surface, a shoe member, and a shaft adjustably connecting the shoe member to the plate, the shoe member being pivotally attached to the shaft permitting it to be positioned to bear on an end surface of the work piece and assist in holding it on the work surface. The system may employ variations of these members and other members as well, to assist in holding the work piece on the work surface and to assist in laying out a design on the work piece or work surface. The system and these elements are set forth in the following detailed description.

BRIEF DESCRIPTION OF THE DRAWINGS

The adjustable work-piece clamping system will be further described in connection with the accompanying drawings in which:

FIG. 5 is a plan view of an adjustable clamping accessory mounted on a work surface;

FIG. 6 is a front view of the adjustable clamping accessory shown in FIG. 5;

FIG. 7 is a side view of the adjustable clamping accessory shown in FIG. 5;

FIGS. 18, 19, and 21 are plan views of portions of work surfaces and work pieces showing the adjustable clamping system components employed in various clamping and assembly operations;

FIG. 20 is a plan view of a double clamping member shown in use on a work surface.

DETAILED DESCRIPTION OF THE PREFERRED EMBODIMENT

Figure 1:
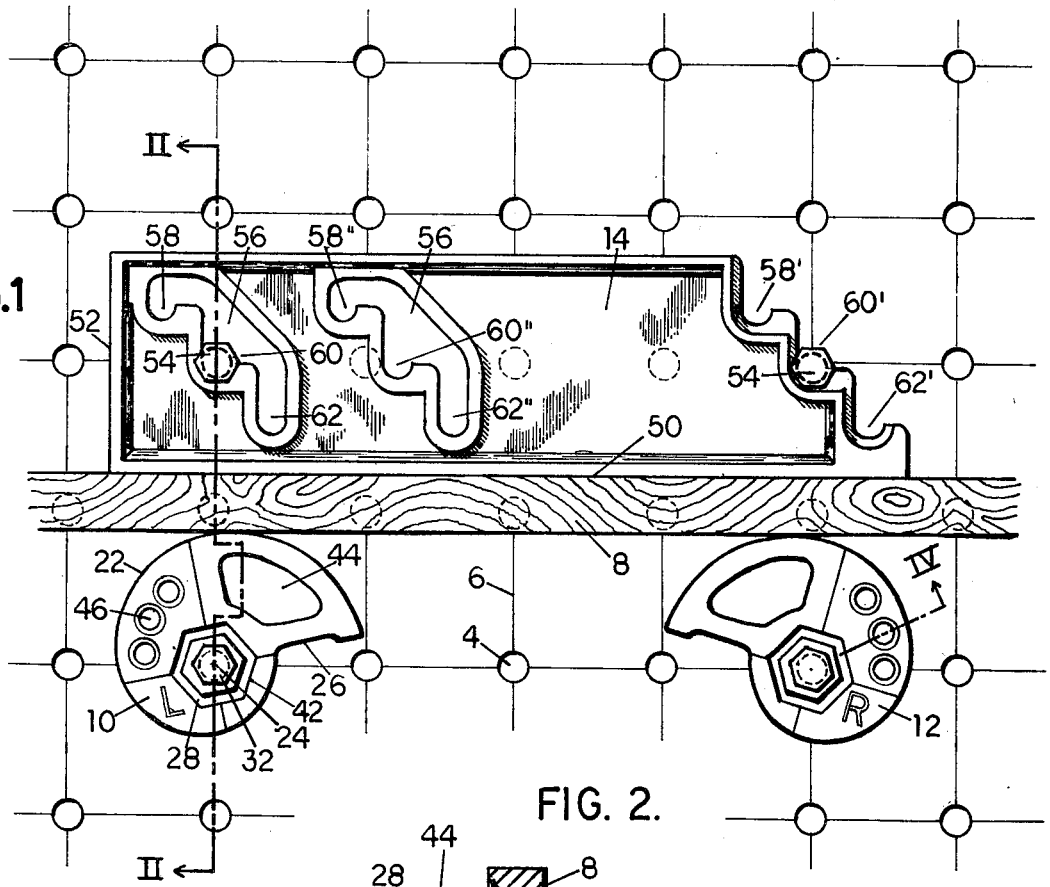
FIG. 1 is a plan view of the system showing a work piece clamped on a work surface by two clamping members and a fence.

For ages, a satisfactory system for firmly holding a work piece on a work surface has been sought, one that was simple and economical in construction and flexible and adaptable in use. Some of the systems which have been devised in the past are discussed in the introduction. Of course, there are other such systems. All of them present some significant problems to the user. Depending upon the operation to be performed on the work piece, at times these problems can render the system virtually useless. The present invention grew out of just such problems. It is deceptively simple in construction, its unique advantages becoming apparent only upon comparison of it with other such previous systems. It has been tested and found to provide the user with "hands he did not know he had." As will be apparent from the following description, it is quick and simple to use. It can hold a single work piece of simple or complex shape, or a variety of work pieces, in most any position on the work surface. Since it does not project above the surface of most work pieces, it permits face-finishing operations to proceed unimpeded. It may be employed to hold the work piece spaced from the work surface, an essential feature for some operations. Most importantly, by virtue of its unique design it will lock the work piece against movement in any direction on the work surface.

In most operations, the system employs discs with a spiral outer surface functioning in opposing pairs or in pairs with a fence to clamp a work piece to the work surface. It is admirably suited for use in virtually all shop operations, operations including holding single or multiple pieces for layout, sawing, planning, routing, shaping, sanding, drilling, doweling, mortising, carving, and gluing operations, to name some examples. Preferably the components of the system are mounted on the work surface by pins, being received in any of a grid of openings in the work surface. This permits pieces of almost any conceivable shape to be clamped to the work surface by rotating the discs around the pins. These components may be employed to hold a single piece during a shaping operation, for example, or they may be used to hold related parts in an assembled relationship. The components can be operated easily to attach or release a work piece or assembly. They may be reoriented easily for another operation, removed quickly to provide an unobstructed work surface, or reset in exactly the same location for repetitive operations. The work pieces are supported on the work surface, usually a bench top, solidly and in a fixed plane. This unique system in use has been found to be amazingly efficient and quite convenient for commercial shops, home craft shops, and hobby activities. All components of the systems are designed to provide sufficient dimensional tolerance to accommodate slight inacurracies in layout or drilling of the grid of openings. They can be sized and adapted for most any application. Because of these features, the system greatly enhances the ability of all users to produce quality craftsmanship.

A basic example of the system in use is illustrated in FIG. 1. It presents a top or plan view of a portion of a work surface 2, typically a bench top in which has been drilled a series of holes or openings 4 aligned in a grid pattern 6. On this surface is supported a work piece 8 against which bears two discs, a left disc 10 and a right disc 12, and on the other side a fence 14. Discs 10 and 12, sometimes referred to as clamping members, generally are thin, flat pieces, typically on the order of three-quarters of an inch thick, having top and bottom surfaces defining generally parallel planes and an outer surface 22 defining a spiral radiating outwardly from a center point. This spiral surface, preferably somewhat roughened, is perpendicular to the top and bottom surfaces of the clamping member. Connecting the ends of the spiral surface is a planar surface 26, preferably generally perpendicular to the inner portion of surface 22 as shown.

Figure 2:
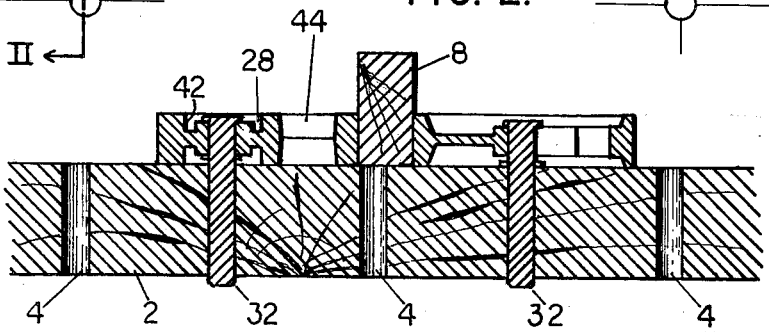
FIG. 2 is a vertical cross section taken along lines II—II of FIG. 1.
Figure 3:
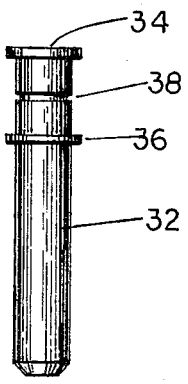
FIG. 3 is a front view of the pin employed to removably attach the clamping members, fence, and other components of the system to the work surface.
Figure 4:
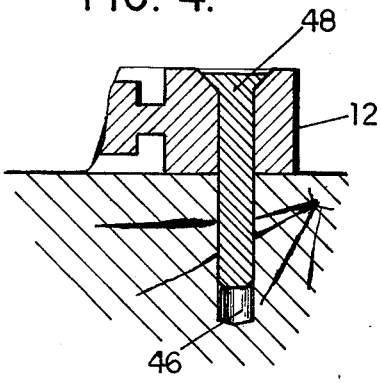
FIG. 4 is an illustration taken along lines IV—IV of FIG. 1.

As best shown in FIG. 2, the clamping members include a thin or recessed transversient 28. An enlarged portion is provided about center 24, and an opening provided therein which receives a pin 32. As best shown in FIG. 3, this pin, sometimes called a pintel pin, includes a head 34,, a groove receiving a retaining clip 36, and a second groove 38 which may receive another retaining clip for holding other parts in certain embodiments of this system. While this pin may be fixed to the clamping member, preferably it is held captive in the central opening through the clamping member by clip 36, the pin being of a size relative to the opening through the disc to permit the disc to rotate freely on the pin without appreciable wobble. Preferably the wall surface 42 about the top and bottom surfaces of the enlarged central portion is of a shape, such as octagonal, to be engaged by a wrench to assist in either clamping or releasing the member against a work piece. The clamping member preferably also includes an opening 44 mainly to permit the user to apply pressure manually to either side of the wall defined by surface 26 to tighten or loosen the clamping member when in use. To assist in holding the discs in a pre-determined position, and in relocating them at a defined position, the discs also may include openings 46. These openings may receive a locking pin 48, as shown in cross section in FIG. 4, the locking pin passing into an opening drilled or provided in the work surface to position the clamping member in a pre-determined orientation. Such an arrangement is especially useful for repetitive setups, or for realigning at a later time a previously assembled structure.

Fence 14 includes a flat surface 50 against which bears the work piece 8, and a flat surface 52 against which a work piece also may bear. This fence is formed as a generally thin flat piece, having a central web interconnecting the working surfaces, the top and bottom of which all define generally parallel planes, these surfaces incorporating various indicia and openings. The fence is attached to the work surface by a pair of pintel pins 54 identical in construction to pintel pin 32. These pins are received in openings 56 shaped as shown in FIG. 1 to provide pockets 58, 60, and 62 for receiving the pins in a holding position (the designations of these various pockets being distinguished in the drawings by the use of primed numbers). The openings and pockets are positioned so that the two outermost openings may be employed to attach the fence to the work surface with face 52 aligned with grid 6. The centers of pockets 58, 60, and 62 each are equidistant from flat surfaces 50 and 52 so that a workpiece clamped against surface 50 will have the same dimensional relationship or alignment to grid 6 as a piece clamped against surface 52, or alignment as are other components of this system, thus achieving automatic squaring of the workpiece to the grid. The center opening 56' may be employed with opening 56'' to attach the fence to the work surface with faces 50 and 52 aligned at 45° to grid 6. The recesses about the openings in the fence provide clearance for the head of pins 54 (normally retaining clips are not used in the pins securing the fence). These openings through the fence as shown in FIG. 1 will permit the fence to be lifted from the pins and the pins relocated in whichever openings are desired to be used.

While the grid and members of the adjustable clamping system may be sized for the intended application, for most normal wood-working operations, it has been found convenient to provide a grid of openings 4 on two-inch centers, and to provide a radial increase in the spiral surface of the clamping members on the order of 1". The variation in spacing of the recesses 58, 60, and 62 in fence 14 from surface 52 also can provide on the order of a 1½" adjustment in the position in which that fence may be fixed to the work surface. Preferably the clamping members are sized, as shown, to bear on the member being clamped at about a 14° angle of incidence; i.e., a line drawn from the center point of the clamp to the center of pressure of the clamp on the clamped number will define an angle of about 14° to a line perpendicular to the surface of the clamped member. The effective portion of the spiral surface about the clamping member terminates at a line tangent to the surface and passing through the outer tip of the clamping member, since the remainder of the inner portion of the surface normally will not be brought to bear on a work piece. More for appearance sake than anything else, preferably this inner portion of the clamping surface is shaped as shown.

It will be noted that both left-hand and right-hand clamping members are disclosed and employed. One is the reverse of the other; by turning one over, the other is achieved. It is helpful to so identify the surface, by different letters as illustrated, by different colors, or finishes, or whatever, to visually differentiate the two and thereby to simplify use of the system. The left-hand clamping member 10, illustrated in FIG. 1, is rotated in a counterclockwise direction to bring its spiral outer surface to bear against work piece 8. The right-hand clamping member 12, on the other hand, is rotated in a clockwise direction to bring its spiral outer surface to bear against the work piece 8. By simultaneously rotating both of these clamping members in opposite directions to bear against work piece 8, any tendency of the work piece to slide in one or the other direction along fence 14 may be negated. Also, when working upon work piece 8, any tendency for it to slip along face 50 of fence 14 is opposed by these two clamping members, clamping member 10 opposing the tendency of work piece 8 to slip to the left while clamping member 12 opposes any tendency of work piece 8 to slip to the right. Thus, this co-operation of the two clamping members permits the work piece to be firmly locked in a given position on the work surface.

An adjustable clamping accessory, shown in FIG. 5, may be used to hold work pieces on the work surface 2' at odd angles to grid 6'. This adjustable clamping accessory 62 includes a plate 64, a shaft 66 threadably received in an opening through plate 64, and a head or shoe member 68 connected to the end of shaft 66 by a ball and socket arrangement. Shoe member 68 includes a flat outer surface 70 to bear against the flat surface of a member to be held by it. Plate 64 incorporates a cylindrical opening 72 at either end of which is a recess, the opening receiving a pin 74 identical to pin 32, the recesses receiving the head and retaining clip of that pin. Plate 64 also includes an elongated slot 76 which includes recesses at either side, this slot also receiving a pin identical to pin 32, the recesses receiving the head and clip of that pin to capture the pin in the slot. Shaft 66 includes at one end a slot 78 permitting it to be turned and its position adjusted relative to the plate to move the shoe member into a position engaging a surface of the work piece to be held by it. The ball and socket connection of shaft 66 and shoe 68 preferably permits at least a 23° angle of movement to either side of the center line defined by grid 6. Because slot 76 permits the adjustable clamping accessory to be positioned at a 45° angle to grid 6 as well as in line with grid 6, this freedom of movement permits the shoe member to bear against and clamp a surface at any angle to the grid.

Figure 8:
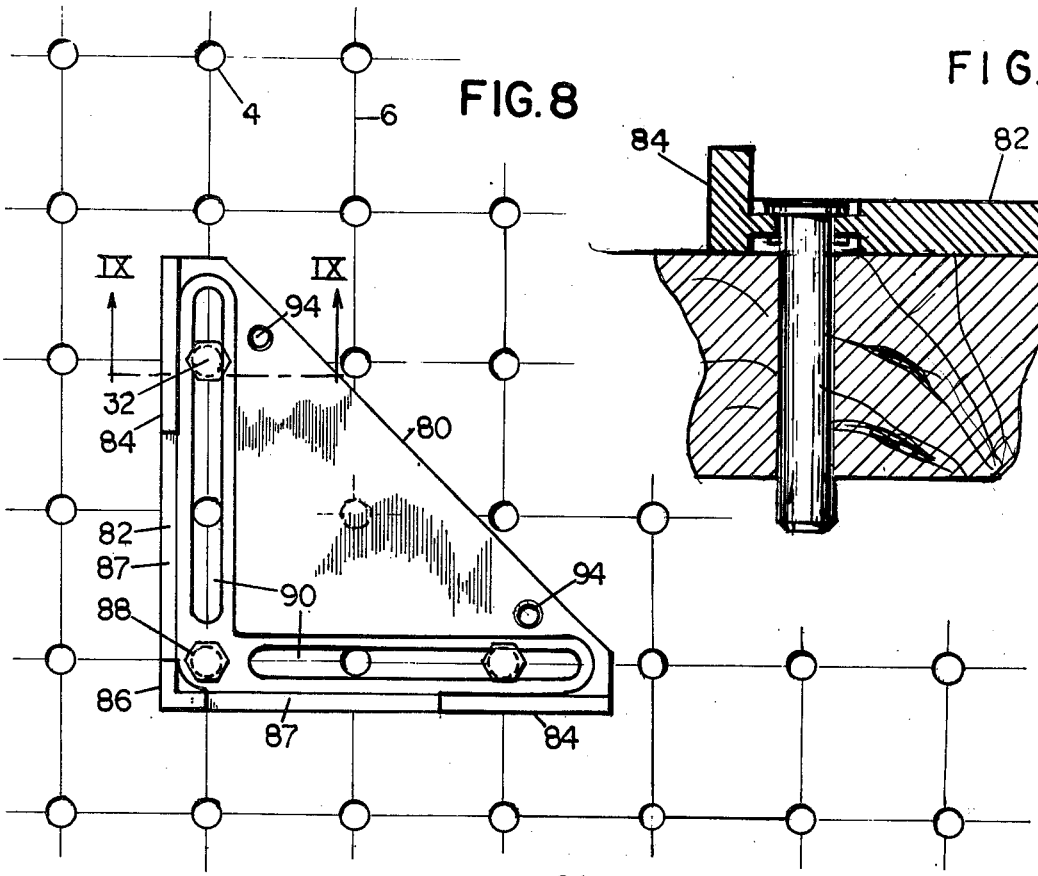
FIG. 8 is a plan view of a frame fixture mounted on a work surface.
Figure 9:
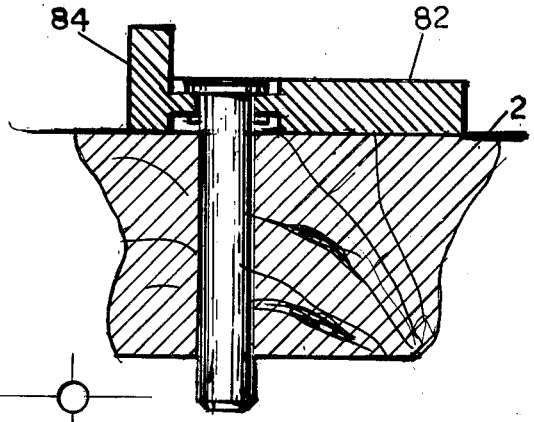
FIG. 9 is a vertical cross section of the frame fixture shown in FIG. 8 taken on lines IX—IX.
Figure 10:
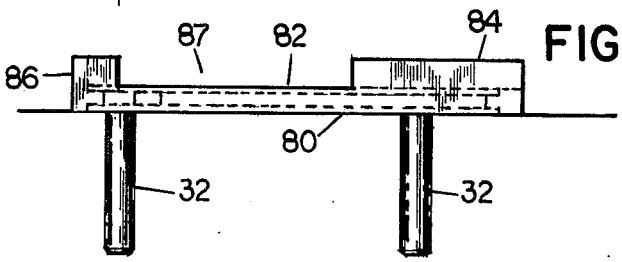
FIG. 10 is a front view of the frame fixture shown in FIG. 8.
Figure 12:
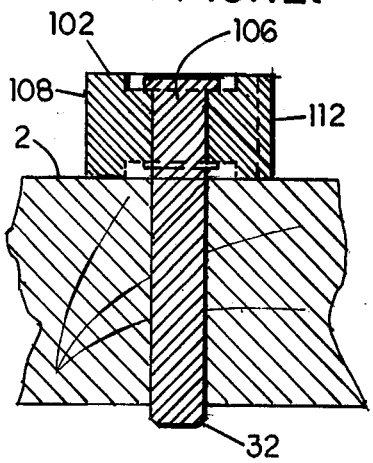
FIG. 12 is a vertical cross-sectional view taken on lines XII—XII of FIG. 11.

A frame fixture, shown in FIG. 8, is quite useful in certain operations, particularly when assembling interior corners of members at right angles to one another or exterior corners such as those of picture frames. This frame fixture 80 includes a base plate 82, vertical walls 84 at each end, and a vertical corner wall 86, the outer surface of which defines a right angle in line with the outer surfaces of wall 84. The inner surfaces of walls 84 and 86 form a right angle to receive members such as picture frames, with opening 87, between walls 84 and 86, for nailing the assembled frame. The frame fixture also includes a cylindrical opening 88 and two slots 90, the opening and slots being outlined by recesses on both sides of plate 82. These openings and slots receive pins identical to pin 32, the recesses receiving the head of that pin. By these pins the frame fixture may be attached to the work surface at various orientations to its grid of openings, openings 88 and slots 90 are spaced from surfaces 84 to achieve the same dimensional relationship to grid 6 as the other components of this system. Slots 90 are of such length that no less than two pins 34 will engage holes 4 in grid 6 when oriented to the grid pattern to thereby hold the fixture square to the grid. Occasionally the frame fixture 80 may be employed in a position such that opening 88 and slots 90 do not relative to openings 4 of grid 6. In such cases the frame fixture then may be fixed in position by clamping discs 10 and 12, as will later be shown. The frame fixture also may include openings 94 to receive locking pins to position the fixture in a predetermined or relocated orientation as desired.

Figure 11:
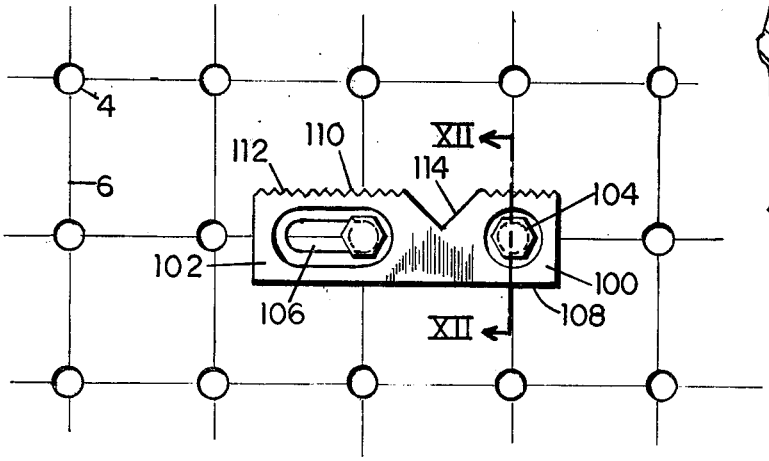
FIG. 11 is a plan view of a bench stop fixture mounted on a work surface.

A simple bench stop, shown for example in FIG. 11, also may be employed to advantage in the adjustable clamping system. This bench stop 100 consists of a flat plate 102 in which is provided a cylindrical opening 104 and a slot opening 106 similar in shape and purpose to opening 74 and slot 76 in plate 64 of the adjustable clamping accessory. One face of the bench stop, such as face 108, is flat and aligned with the plane passing through the center of opening 104 and slot 106 to permit a work piece aligned with the grid of openings on the work surface to bear flat against that face. Slot 106 permits the bench stop to be attached oriented at 45° to the grid. The opposite face of the bench stop, face 110, may include serrations 112 and a right angle notch 114, the serrations providing increased friction to more firmly hold a work piece, notch 114 receiving the corner of a work piece, or the corner of members being assembled at right angles to one another. Faces 108, 110, and the end faces are all spaced from the center lines to achieve the same dimensional relation to grid 6 as the other components of this system.

Figure 13:
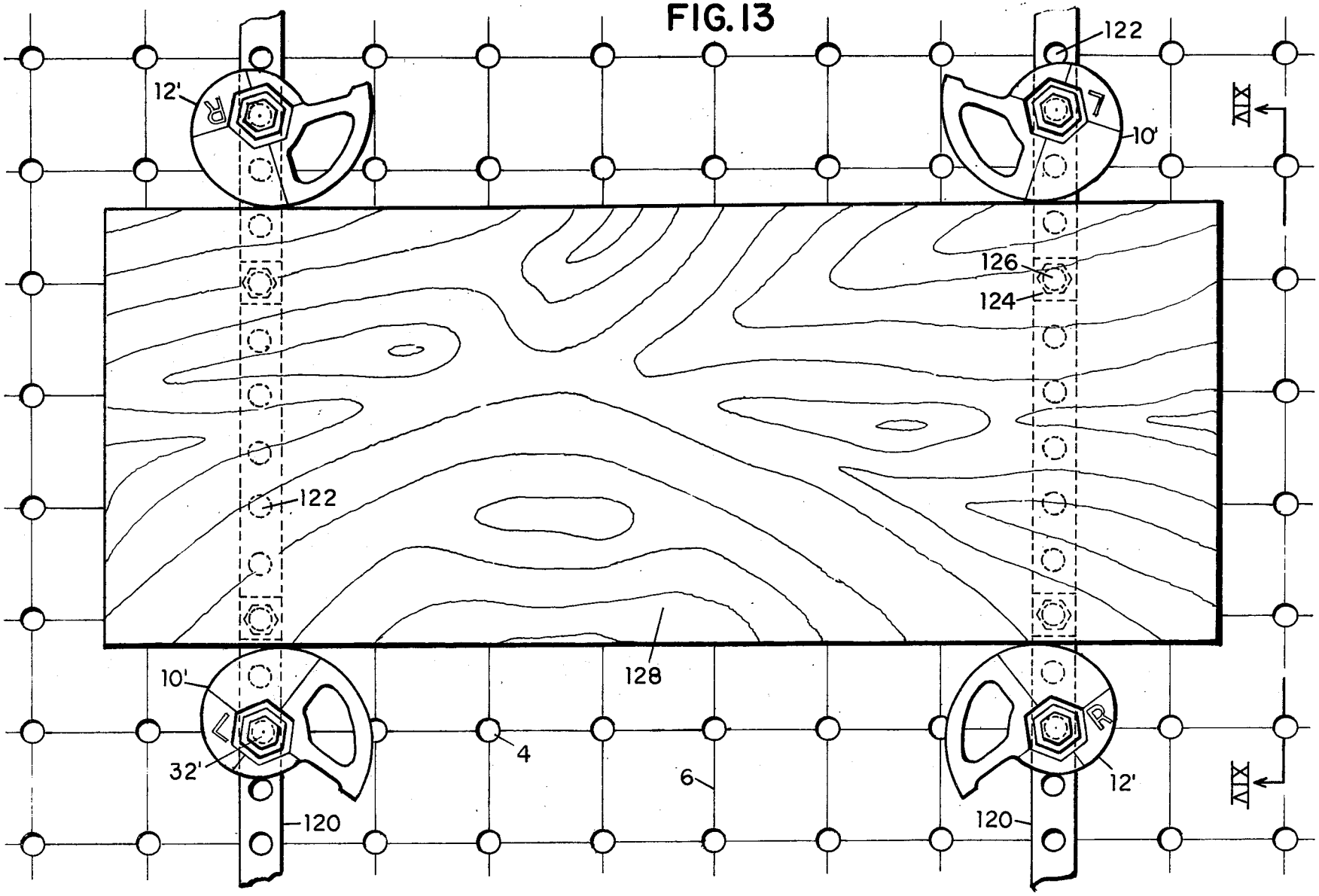
FIG. 13 is a plan view of an elevational fixture mounted on a work surface.
Figure 14:
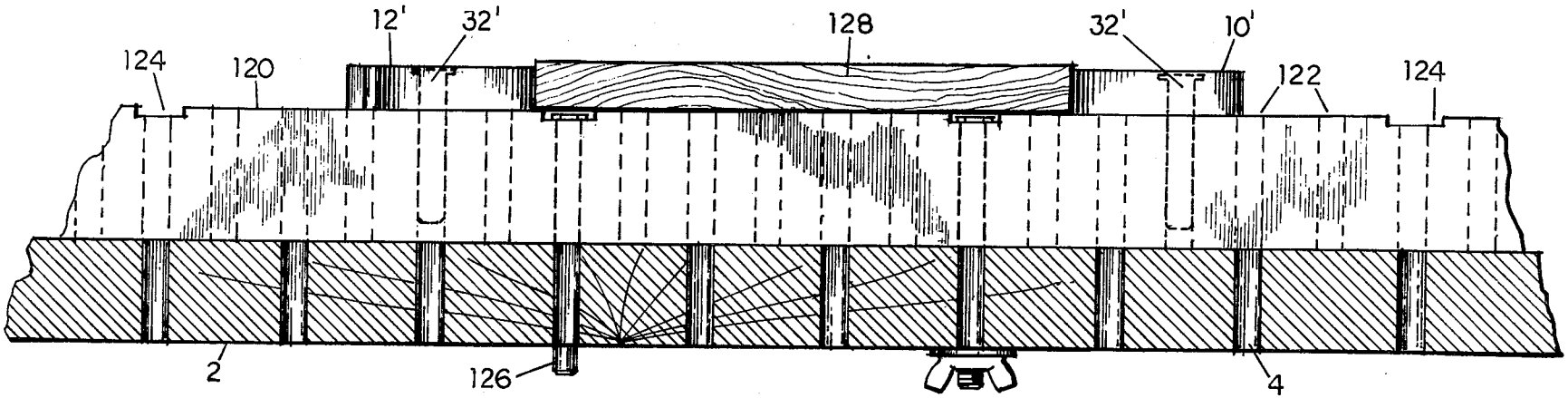
FIG. 14 is a side view of a portion of one of the elevational fixtures shown in FIG. 13.

For many operations, it is necessary to work through the work piece while it is firmly supported. For example, when using a sabersaw to remove a portion of a work piece, it is necessary to hold the work piece spaced from the supporting surface. As another example, when routing a work piece, it is necessary to provide sufficient clearance on one side of the work piece for a router bit pilot and on the other side of the work piece for the router itself. Such requirements present a significant challenge to virtually all known clamping systems. The present clamping system, however, by employing the elevational fixture illustrated in FIG. 13 easily can accommodate such operations. This elevational fixture consists of a vertical fence 120 through which passes a series of openings 122. About certain of these openings is a recess 124, this recess receiving the head of a pin 126 that passes through opening 122 and an align opening in grid system 6' of the work table to connect the vertical fence 120 to the work table. Others of openings 122 may receive pins 32' of clamping members 10' and 12', as illustrated, to permit these clamping members to be brought to bear against the side edges of a work piece 128, as illustrated, clamping that work piece spaced from the work surface by the height of the vertical fence. The pins holding the vertical fence to the work surface simply may be passed through openings in that work surface, or may be bolted to the work surface as illustrated in FIG. 14.

Figures 15, 16, 17:
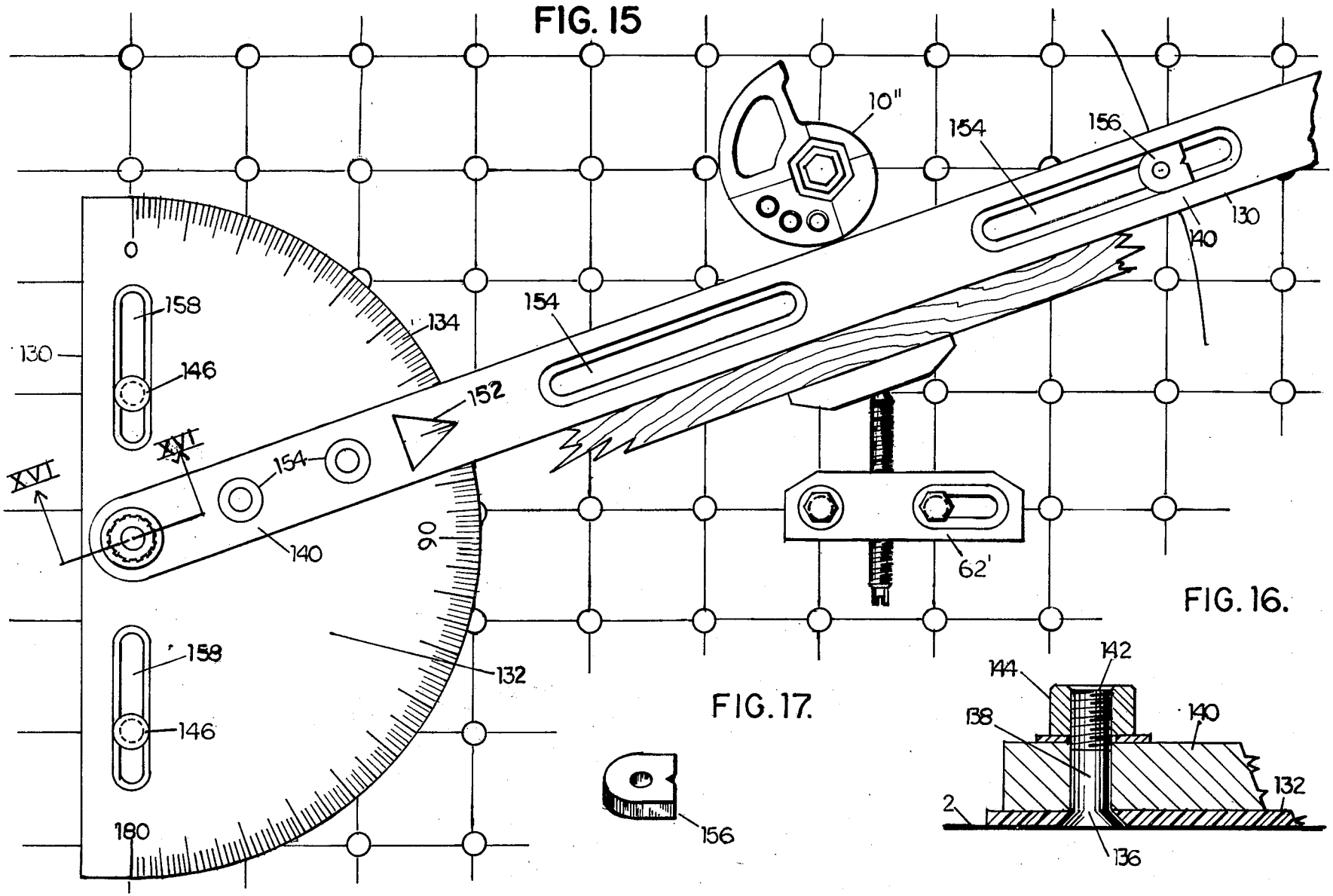
FIG. 15 is a plan view of the layout fixture mounted on the work surface together with a clamping member and an adjustable clamping accessory.
FIG. 16 is a vertical cross sectional view of the layout fixture taken on line XVI—XVI of FIG. 15.
FIG. 17 is an isometric view of a scribe member employed in the layout fixture.

When laying out patterns on a work piece, or on the bench surface, it is very useful to employ the layout fixture illustrated in FIG. 15. This fixture 130 includes a protractor plate 132 preferably providing a full 180° of angular indicia 134 about its semi-circular side surface. It also includes an opening 136 (see FIG. 16) aligned with an opening 138 in arm 140, bolt 142 passing through these openings and connecting protractor plate 132 to arm 140 by nut 144 under which preferably is positioned a washer of a material to minimize the friction between the nut and the arm. Such a washer also may be provided, if desired, between arm 140 and protactor plate 132. The layout fixture is adjustably connected to the work surface by pins 146 received in slots 158 through the protractor plate, permitting the location of the fixture to be adjusted to the exact position required.

Arm 140 includes a triangular window 152, the point of which is directed away from opening 138 and aligned with the center axis of arm 140 to accurately designate the angle at which the side faces of arm 140 are positioned relative to the grid surface on the work table, this angle being exposed in the angular scale 134 revealed by window 152. Arm 140 also includes a series of openings 154, some of which are cylindrical, others of which are slots, the cylindrical openings permitting arm 140 to be pinned to the work surface, the slots receiving a sliding scribe member 146 (shown in isometric in FIG. 17). The scribe member, held by friction in any of slots 154, includes an opening for a pencil point or the like, and a notch on one edge to receive a steel scribe stylus or the like. By this arrangement, the arm may be pinned to the table, adjusted, and an arc of a given radius drawn on the table or on an underlying work piece. Thus, by employing layout fixture, lines at any angle and arcs at any radius may be drawn on the work piece or work surface. The layout fixture also provides a surface against which a work piece may be clamped for example by the co-operation of a clamping member 10'' and the adjustable clamping accessory 62' as shown in FIG. 15.

Figure 21:
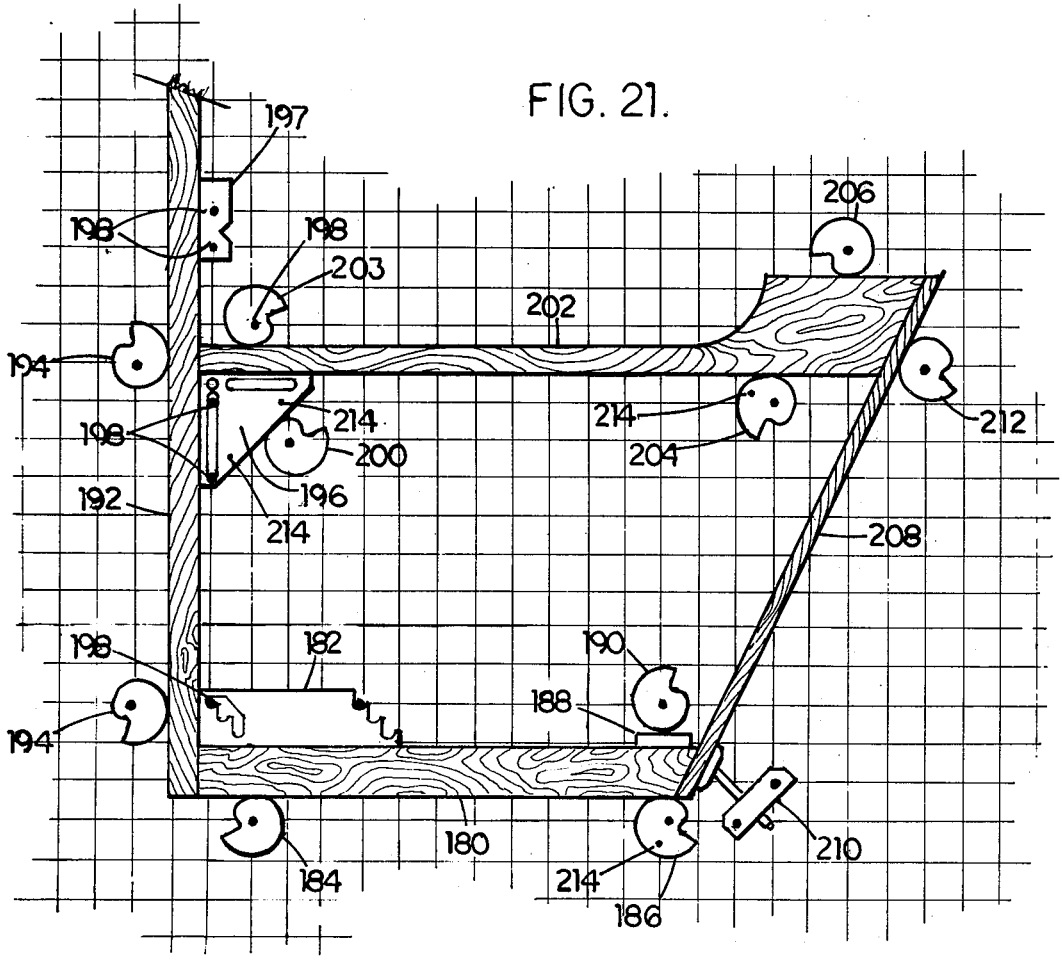

FIGS. 18, 19, and 21 illustrate the usefulness and inter-co-operation of these members, components and accessories to hold virtually any shape work piece to the work surface. For example, as illustrated in FIG. 18, a triangular work piece 160 may be held to the work surface by two clamping members and a bench stop. Circular work piece 162 may be held to the surface by three clamping members and a bench stop, the bench stop being employed to impede rotation of work piece 162 as the clamping members are brought to bear against its outer edge.

In the lower portion of FIG. 18 is illustrated an assembly operation such as might be performed during the fabrication of a bullnose stair riser. In such a fabrication, a work piece 164, provided with a semi-cylindrical corner edge, receives a work piece 166, a portion of which has been kerfed to permit it to be wrapped around the semi-circular edge of work piece 164. To assemble these work pieces, preferably a fence is employed to bear against one side of work piece 164, then work piece 166 is brought to bear against the other side of work piece 164 and two clamping members employed to clamp the two work pieces in that relationship as illustrated. Then the end of work piece 166 is gradually wrapped around the semi-cylindrical end of work piece 164 as additional clamping members are applied to hold the work pieces in this wrapped relationship, completing the assembly.

At times, insufficient surface area will be exposed along the work piece to permit two separate opposed clamping members to be applied, as illustrated for example in FIG. 1. In such cases, clamping member 170, illustrated in FIG. 19, may be employed in co-operation, for example, with a fence. Alternatively, such small pieces may be held by the face of a block large enough to be clamped by two clamping members. Clamping member 170 consists of two disc members each approximately half the thickness of a normal clamping member, these discs both being received on the same pintel pin 172. By adding a retaining clip in slot 38 of the pintel pin, as shown in FIG. 3, the two discs of clamping member 170 may be individually locked to pin 172. The spiral surface of one of these discs radiates outward in a clockwise direction while the spiral surface of the other of these discs (the top disc shown in FIG. 19) radiates outward in a counter-clockwise direction. Accordingly, these discs simultaneously may be rotated and brought to bear against a small work piece, forcing it against a fence, for example, and clamping it in a given position while opposing any tendency of that work piece to move either to the left or to the right. Half-thickness clamping discs, when mounted individually on a pin, are exceptionally useful in holding a work piece for layout, permitting a try square, combination, or bevel square to lay flat on the work piece yet pass freely over the half-thickness clamping disc. Other vise systems will not permit this, which limitation can frustrate many operations.

Clamping members may be employed, as shown in FIG. 20, to hold a multiplicity of work pieces in an abutting relationship, permitting their edges or top surfaces to be finished simultaneously in one operation, gluing or other operations to be simultaneously performed on these work pieces. If it is desired to raise the work pieces further above the clamping members, one or more shims may be placed beneath the work pieces.

A complex assembly, employing many of the members, fixtures, and accessories previously described, is illustrated in FIG. 21. In its, a work piece 180 is clamped against fence 182 by a clamping member 184, and the right end of work piece 182 secured in alignment with the grid by clamping member 186, opposed by block 188 and clamping member 190. Work piece 192 is secured against the fence 182 and against a prelocated frame fixture 196 and bench stop 197 by clamping members 194. Pins 198, being in the same grid line, automatically square work pieces 180 and 192. Work piece 202 is brought to the pre-determined layout point on work piece 192 by adjusting frame clamp 203 to hold it against fixture 196. Work piece 202 is thus held square and at the proper connecting point with work piece 192. The right end of work piece 202 is held in alignment with the grid by clamping member 204 and secured by opposing clamping member 206. Work piece 208 is clamped against the end of work piece 180 by adjustable clamping accessory 210 for example and against the end of work piece 202 by clamping member 212. Members of the jig thus formed in the assembly above described may be removed and later re-positioned for an identical assembly by means of holes placed in the work surface to receive locking pins at locations 214. As this example well illustrates, even complex structures may be accurately fabricated and assembled using the components of the adjustable clamping system.

Figure 22:
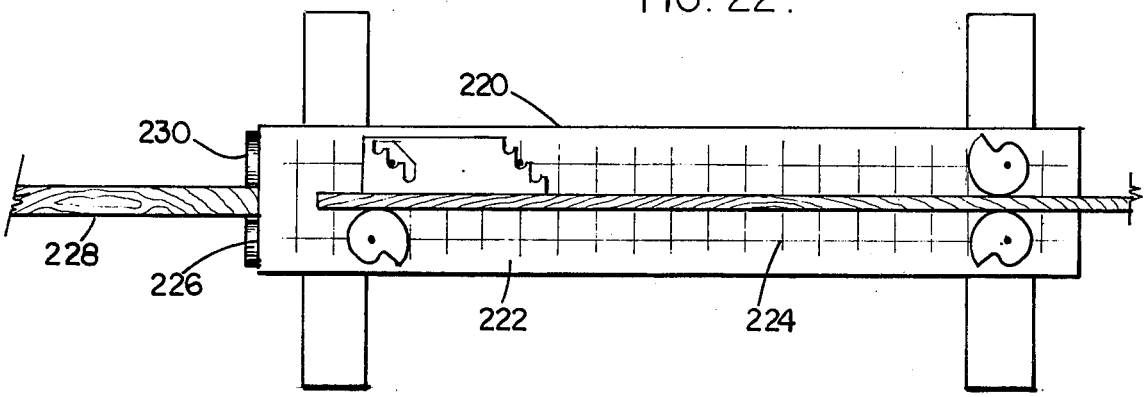
FIG. 22 is a top view of a saw-horse employing the adjustable clamping system to hold two work pieces.

Not only is this system admirably suited to shop operations, but it is also well suited to field use. For example, as illustrated in FIG. 22 a saw horse 220 may be provided with a horizontal surface 222 incorporating a grid of openings 224 and a vertical surface 226 incorporating a similar grid of openings. The horizontal surface may be used to clamp members as illustrated; the vertical surface also may be used to clamp members. For example, clamping members 230 attached to the vertical surface 226 may firmly hold the end of a door 228, permitting its edge to be dressed and necessary hardware to be installed.

The disclosed clamping system may be adapted to almost any home or industrial work surface simply by providing it with a grid of openings. The openings may receive pins attaching the clamping members to the work surface, as shown and described, or they may receive pins attaching other structures, such as a mitra saw box, to the work surface. These openings may fill with shavings and sawdust from time to time. Upon inserting a pintel pin or pencil, for example, into an opening, however, such material will be forced through the opening and the opening automatically cleared. Since the openings in the work surface will be used repeatedly, and since they should receive the pins snugly and without appreciable wobble, it is desirable, when employing a relatively thin or plastic material as the work surface, to incorporate in each opening a sleeve of a durable material, such as metal, to provide rugged bearing surfaces for the pins.

While a perferred system has been described, it should be clear that the disclosed adjustable clamping system may be modified in many respects while still retaining the essential features and advantages of the system. Accordingly, the scope of the invention is defined, not by the disclosed embodiment, but rather by the following claims.

I claim:

1. An adjustable clamping system for holding a work piece in a fixed position relative to a work surface, the system including:

A work surface having a grid of openings, the grid defining two orthagonal directions, one in line with the row of openings, the other in line with the column of openings;

fence means having a bearing surface for opposing movement of a work piece on a work surface, the fence means including a flat surface against which a work piece may bear, and at least three laterally spaced pockets for receiving the shaft of a pin to removably attach the fence to the work surface, the outer pockets being positioned to attach the fence with its flat surface in line with a row or column of the openings, the center pocket being positioned to, with one of the outer pockets attach the fence with its flat surface generally at a 45 degree angle to the rows and columns of openings in the work surface;

pin means for removably attaching the fence to the work surface;

means for releasably clamping work piece against the bearing surface of the fence means comprising first and second clamping members;

said first clamping member including a spiral outer surface radiating outwardly in a clockwise direction;

pin means to pivotally attach the first clamping member to the work surface;

said second clamping member including a spiral outer surface radiating outwardly in a counterclockwise direction; and pin means to pivotally attach the second clamping member to the work surface, whereby the workpiece may be clamped to a work surface against the fence means by the first and second clamping members by rotating the clamping members in opposite directions to bear against the workpiece.

2. An adjustable clamping system as set forth in claim 1 in which each clamping member is a generally thin, flat piece, the top and bottom surfaces of which define generally parallel planes, the spiral surfaces being generally perpendicular to the top and bottom surfaces, the spiral defining a surface that uniformly increases in radial distance as it changes angle about its center, the means to pivotally attach the clamping member to the work surface attaching the clamping member to the work surface at the center of the spiral defined by the spiral surface.

3. An adjustable clamping system as set forth in claim 1 in which each socket of the fence means includes a multiplicity of openings, each shaped to receive a pin in a spacing defined by the grid of openings in the work surface to permit the fence means to be removably attached to the work surface.

4. An adjustable clamping system as set forth in claim 3 in which the openings in the fence means are shaped to receive pins at a multiplicity of spacings from the bearing surface.

* * * * *